US007058343B1

(12) United States Patent
Biegelsen

(10) Patent No.: US 7,058,343 B1
(45) Date of Patent: Jun. 6, 2006

(54) SYSTEMS AND METHODS FOR IN-SITU REPLENISHMENT OF CONSUMABLE ITEMS

(75) Inventor: David K. Biegelsen, Portola Valley, CA (US)

(73) Assignee: Palo Alto Research Center, Incorporated, Palo Alto, CA (US)

( * ) Notice: Subject to any disclaimer, the term of this patent is extended or adjusted under 35 U.S.C. 154(b) by 0 days.

(21) Appl. No.: 11/012,596

(22) Filed: Dec. 16, 2004

(51) Int. Cl.
*G03G 15/08* (2006.01)

(52) U.S. Cl. ..... 399/258; 399/238; 399/1; 399/411; 53/492

(58) Field of Classification Search ..... 399/258, 399/411, 1, 238
See application file for complete search history.

(56) References Cited

U.S. PATENT DOCUMENTS 5,815,780 A * 9/1998 Boerger ..... 399/260
5,992,628 A * 11/1999 Vermilion et al. ..... 206/447
2005/0092624 A1* 5/2005 Harper ..... 206/205

* cited by examiner

*Primary Examiner*—David M. Gray
*Assistant Examiner*—Ryan D. Walsh
(74) *Attorney, Agent, or Firm*—Oliff & Berridge, PLC

(57) ABSTRACT

A self-replenishing image forming apparatus replenishes reservoirs of consumable materials using packages of the consumable materials transported in the marking media path of the image forming apparatus. The packages are separated from the regular marking media at a sheet diverter, the consumable material is unpackaged, and transformed into a form suitable for storing in the consumable reservoir.

19 Claims, 3 Drawing Sheets

FIG. 5
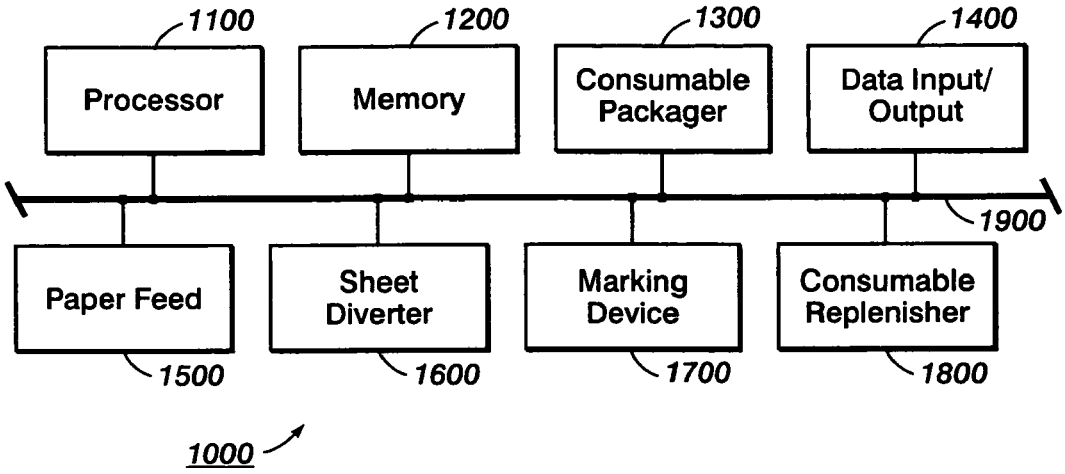
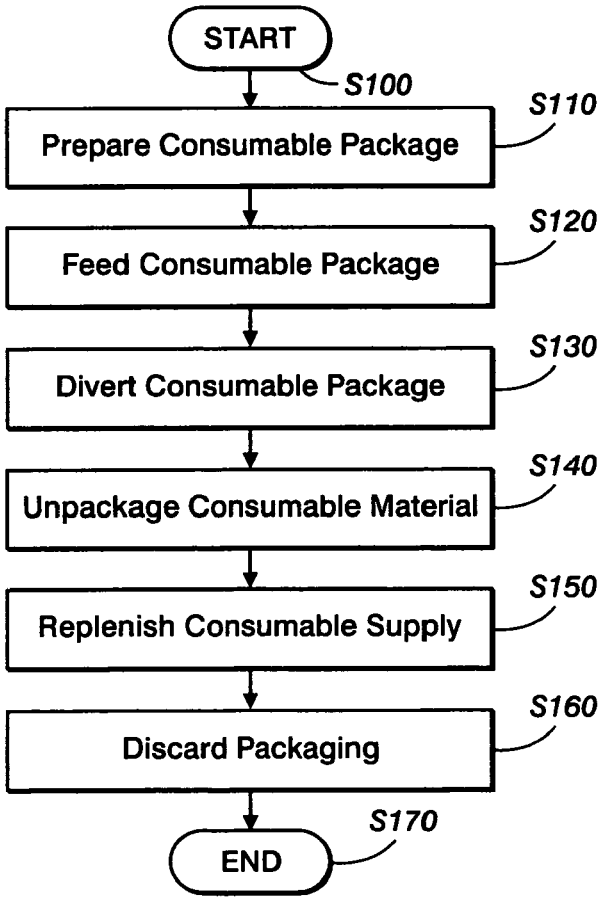
FIG. 6

SYSTEMS AND METHODS FOR IN-SITU REPLENISHMENT OF CONSUMABLE ITEMS

BACKGROUND

1. Field

This invention is directed to the replenishment of consumable items in an image forming apparatus.

2. Description of Related Art

Consumable items, such as ink and toner, are used to form an image on a recording medium such as paper, by an image forming apparatus. Substantial development effort has been applied to the engineering of these image forming apparatuses, with the goal of increasing the output and making routine maintenance less frequent. However, the consumable items must still be replenished periodically in order for the device to continue output. In general, replenishment is performed by human operators, who interrupt the operation of the machine in order to refill a reservoir with the appropriate consumable item. Such necessary interruption increases the apparatus downtime, reducing the throughput and increasing the maintenance expenses for the devices.

In order to reduce the frequency with which such routine maintenance must be performed, the reservoirs may be made larger; however, this may increase the size of the machine, and may not be acceptable for consumable items which must be used relatively quickly. For example, large reservoirs of ink may dry out or change in color, and therefore may not be stored for long periods of time in large reservoirs.

SUMMARY

It would be advantageous to design an image forming apparatus which does not require frequent, periodic interruption to continue operation.

Systems and methods may include an image forming apparatus which automatically refills a reservoir, without interrupting the flow of material through the device or operation of the device. The reservoir thereof may be refilled by sending a consumable item along a transport path of the image forming apparatus, and depositing the consumable item in the reservoir. This is particularly useful for systems composed of a plurality of marking engines where a single centralized source of consumables can be enabled.

The consumable item may be packaged in a manner similar to the items usually handled by the image forming apparatus, such as paper. The packaged consumable item may be sent along the paper path similarly to an ordinary sheet of paper. However, at a desired location, such as a location of a marking engine of the image forming apparatus, the packaged consumable item may be diverted from the paper path and into an unpackaging station. At the unpackaging station, the consumable item may be unpackaged and deposited in the reservoir.

Any of a plurality of packaging systems may be used, such as laminating with polyester or other flexible polymer sheet, adhering to a backing, or capturing in a flexible matrix. Any of a plurality of unpackaging systems may also be used, such as melting, dissolving, evaporating, or delaminating.

These and other features and advantages are described in, or are apparent from, the following detailed description.

BRIEF DESCRIPTION OF THE DRAWINGS

Various details are described below, with reference to the following figures, wherein:

FIG. 5 is a functional block diagram of an exemplary self-replenishing image forming apparatus; and FIG. 6 is an exemplary method for self-replenishing of consumable items.

DETAILED DESCRIPTION OF EXEMPLARY EMBODIMENTS

Various exemplary systems and methods provide a self-replenishing image forming apparatus, which replenishes a supply of a consumable item without human intervention. Such systems and methods may be applied to any desirable consumable item, such as ink, toner (including flow enhancers and other optional components), printable electronic material precursors, or resist materials such as wax, which are collectively referred to herein as a "consumable." The consumable may be packaged in a removable packaging material. The packaged consumable item is referred to herein as a "consumable package," which may have the same form factor as other items transported by the image forming apparatus, such as paper.

Figure 1:
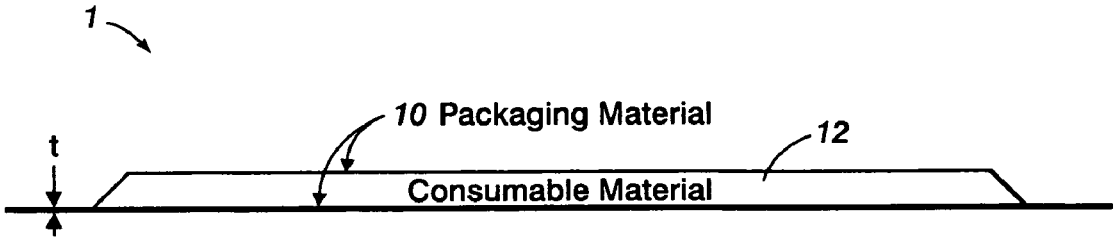
FIG. 1 is a side view of an exemplary consumable package.

FIG. 1 shows a side view of an exemplary consumable package 1, in which a consumable material 12 is encapsulated by a packaging material 10. The packaging material 10 may be a flexible polymer sheet such as, for example, Mylar®. Consumable material 12 may be laminated between the sheets of plastic flexible polymer, as shown in FIG. 1. The maximum thickness, t, of the consumable package 1 may be consistent with the maximum thickness of the paper handled by the image forming apparatus, which may be card stock of $1/32^{nd}$ inch or even $1/16^{th}$ inch thick, for example.

Figure 2:
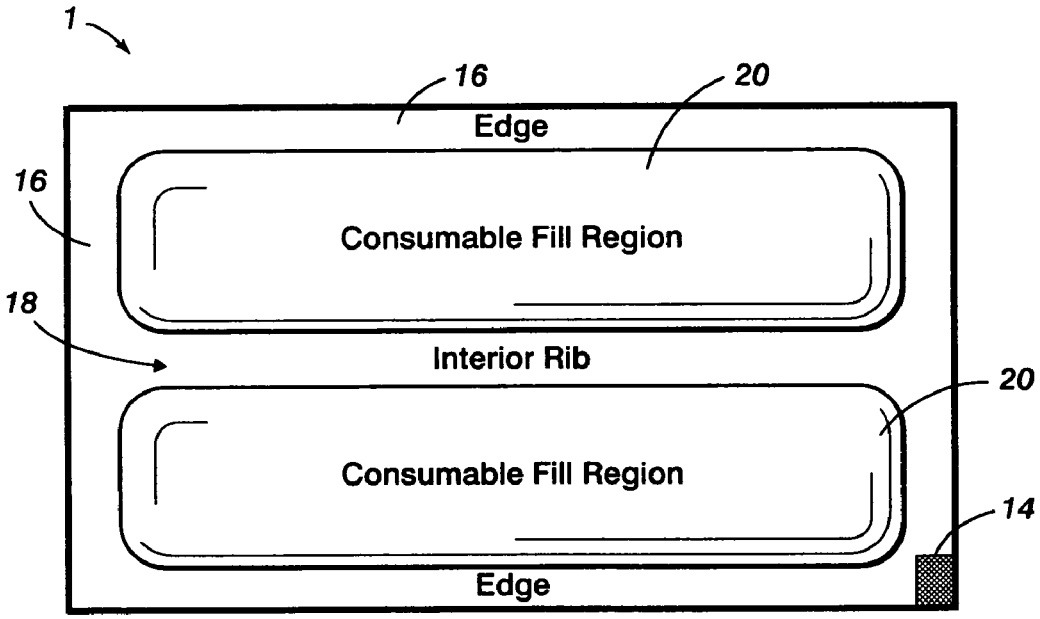
FIG. 2 shows a top view of the exemplary consumable package of FIG. 1.

FIG. 2 is a top view of consumable package 1. Consumable fill regions 20 may contain consumable 12 (FIG. 1) and may be sealed along the edges 16 of the packaging material 10, by an adhesive for example, or by thermal bonding. The consumable 12 may also be excluded from interior rib region 18, by adhering packaging material 10 in this region 18 as well. The regions 16 and 18 which do not contain consumable 12 may be those regions of the consumable package 1 which will be grasped or manipulated by the rollers or transport mechanism, that transports the regular paper through the image forming apparatus. Other regions, such as consumable fill regions 20, are filled with consumable 12. This approach may be advantageous for systems in which the consumable 12 is a loose material or is in liquid form, in which pressure exerted by the rollers or transport mechanism on consumable fill regions 20 could stress the sealing edges 16 and 18.

In the regions 16 and 18, the thickness of consumable package 1 may be less than $1/32^{nd}$ inch, for example. However, in the consumable fill regions 20, the thickness of the consumable package 1 may be substantially thicker, so that regions 20 may be filled with sufficient consumable 12 to refill the reservoir partially when the reservoir is depleted by more than some amount. The only limitation on the thickness of the consumable package 1 in fill regions 20 is that the thickness should not interfere with any elements of the paper transport mechanism. Alternatively the package could consist of preformed packages into which the consumable is blown. The package could then be sealed. At the point of use the seal could be opened and the contents blown out. The package could then be resealed and recycled, returned to the package filler, or disposed of.

The fill regions 20 may contain a sufficient quantity of consumable material 12 to replenish the consumable reservoir without inserting a large number of consumable packages 1 into the paper transport mechanism. This is because the insertion of consumable packages 1 will reduce the total page output of the image forming apparatus by the number of consumable packages 1 inserted into the paper transport mechanism. In one example, each consumable package 1 contains enough consumable material 12 to generate at least 100 sheets of output. Accordingly, the output of the image forming apparatus will only be reduced by about 1%.

Consumable packaging material 10 may include any flexible material which may easily be removed to release the consumable material 12. Suitable packaging schemes may include laminating the consumable material 12 between sheets of flexible polymer material, polyimide, paper, or shrink wrapping, which can subsequently be delaminated. Alternatively, the packaging material may be a material which may be removed by melting, evaporating, sublimating, or dissolving. Such sheets may be created by sintering particles consisting of a core of consumable material covered by a polymer coat. Such a polymer coat may be formed of a bifunctional molecular species which is hydrophobic at one end and hydrophilic at the other. The hybrid particles can then be dissolved in an ionic low temperature melting material. Alternatively the particles can be dissolved within a liquid polymer matrix and solidified into a flexible sheet. If the matrix material has a low melting point, it can be selectively melted and phase separated from the particles.

Other methods of unpackaging the consumable item from the packaging material include exposing a photovolatile polymer to ultra-violet light, which decomposes the photovolatile polymer. Alternatively, the packaging can be made of sublimable materials which can be removed at temperatures below the glass transition temperature of toners and optionally in a reduced pressure environment such as naphthalene, paradichlorobenzene, or camphor.

Some consumables, such as wax, used in phase change ink jet printers, may even be transported bare, if they are a available in a solid form which is flexible and sufficiently robust to contact the rollers of the transport mechanism without transferring consumable material 12 to the rollers. In this situation, the consumable material 12 may be transported without packaging material to be deposited into the reservoir.

The consumable may be deposited in the consumable reservoir by any of delaminating, emptying the package by evacuation or pressurization, squegeeing, melting, evaporating, sublimating or dissolving the material into a form storable in the consumable reservoir, and usable by the image forming apparatus.

The consumable package 1 may also include a package distinguishing mark 14. The package distinguishing mark 14 may be a mark applied only to the consumable package 1, which distinguishes the package 1 from sheets of ordinary marking media. The term "marking media," as used herein, corresponds to any material used by the image forming device to render the images for viewing, for example, paper or transparencies. Package distinguishing mark 14 may be a printed or embossed bar code, a darkly colored area, or alternatively, a notch removed from the consumable package 1. An optical sensor, for example, may detect the presence of package distinguishing mark 14 so as to identify the item as a consumable package 1, rather than a sheet of ordinary marking media.

If multiple consumable reservoirs are provided in a given image forming device, there may also be provided a plurality of package distinguishing marks, each mark identifying the consumable package as being appropriate for a particular one of the multiple consumable reservoirs. For example, for a three-color image forming device, there may be provided three ink reservoirs, for cyan, yellow and magenta, for example. There may then be provided three package distinguishing marks which identify a given consumable package as containing the consumable stored in the cyan reservoir, the yellow reservoir, or the magenta reservoir, respectively.

Figure 3:
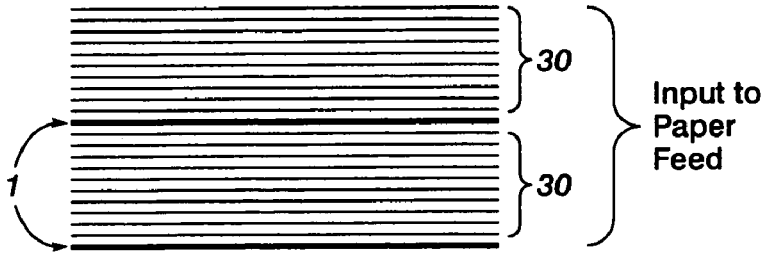
FIG. 3 is side view of a paper input to a paper supply of an exemplary self-replenishing image forming apparatus.

The consumable package 1 may be introduced into the self-replenishing image forming apparatus by interleaving consumable packages 1 with sheets of ordinary marking media, and inserting the interleaved stack into the marking media input of the self-replenishing image forming apparatus. This approach is shown in FIG. 3, which shows a stack of marking media 30, interleaved with consumable packages 1. The self-replenishing image forming apparatus may then discern the presence of a consumable package 1, as opposed to a sheet of marking media 30, based on the package distinguishing mark. The self-replenishing image forming apparatus may then divert the consumable package to an unpackaging station, as discussed further below, while the regular marking media is transported along the usual marking media transport path to the marking engine of the self-replenishing image forming apparatus.

Alternatively, the consumable packages 1 may be interspersed with sheets of ordinary marking media at the output of a consumable packager, as described further below. The locations of the consumable packages 1 within the marking media stream is then known to the self-replenishing image forming apparatus controller (a processor), which may then direct the consumable packages 1 to the appropriate path within the self-replenishing image forming apparatus.

Alternatively, the consumable packages 1 may be manufactured at a manufacturing facility, and packaged for shipment to the location of the image forming device similar to a ream of paper. The consumable packages 1 may then be inserted into a consumable packages feeder, arranged to insert the consumable packages 1 into the marking media path with the sheets of ordinary marking media.

Figure 4:
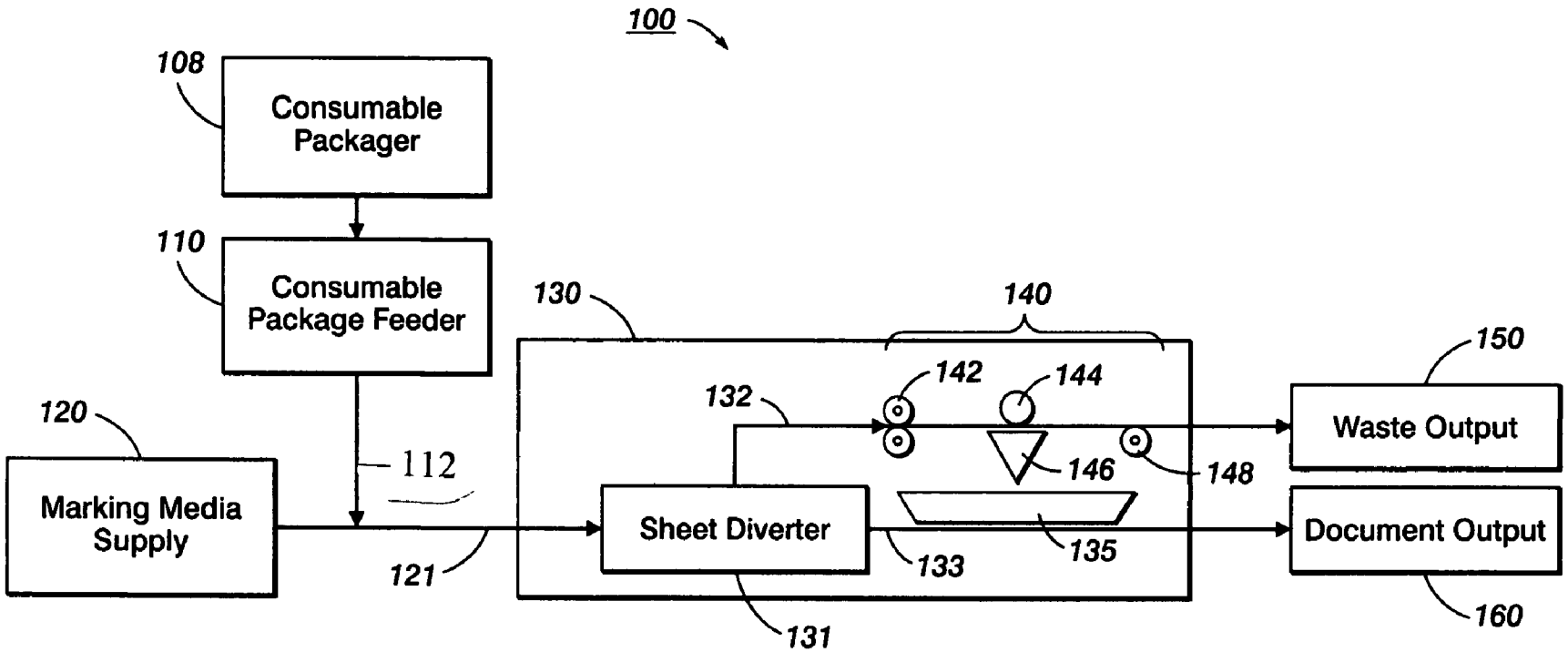
FIG. 4 is a diagram of an exemplary self-replenishing image forming apparatus.

FIG. 4 is a diagram of an exemplary self-replenishing image forming apparatus 100. Self-replenishing image forming apparatus 100 may include at least a marking media supply 120, a consumable packager 108, a consumable package feeder 110, a marking engine 130, a waste output 150 and a document output 160. The marking media path through self-replenishing image forming apparatus 100 is shown by the arrows as indicated.

The marking engine 130 may also include the following components: a sheet diverter 131, a marking device 135, and a consumable replenisher 140. The consumable replenisher 140 may include a consumable unpackager 142, a consumable transformer 144, a consumable reservoir 146, and a support roller 148.

The consumable packager 108 packages the consumable material 12 in a package 1 having a form factor which can be transported by the marking media path of the self-replenishing image forming apparatus 100. Consumable package 1 may be configured as shown, for example, in FIG. 2, in a form factor similar to an ordinary sheet of marking media, with the consumable material 12 confined to the consumable fill regions 20.

The consumable packager 108 may package the consumable material, if it is solid, by laminating the consumable material between sheets of flexible polymer, such as Mylar®. Alternatively, the consumable packager 108 may package the consumable material, if it is solid, by merely adhering the consumable material to a flexible support backing. As another alternative, the consumable packager may package the consumable material, if it is liquid, by injecting the consumable material into the fill regions 20 shown in FIG. 2, and sealing the edges of fill regions 20. As described above, the consumable packager may also create the package by sintering particles consisting of a core of consumable material covered by a polymer coat, or by dissolving within a liquid polymer matrix and solidifying into a flexible sheet.

It should be understood that the inclusion of consumable packager 108 is optional, and alternatively, the consumable packages may be purchased from another manufacturer and inserted in the marking media stream by the consumable package feeder 110, described below.

Consumable package feeder 110 introduces the consumable package into a marking media path 121 along a consumable package path 112. In the marking media path 121, the consumable package is interspersed with sheets of ordinary marking media from the marking media supply 120. Both consumable package feeder 110 and marking media supply 120 may be coupled to a processor (not shown) which keeps track of the locations of consumable packages, relative to sheets of normal marking media, within the marking media stream being transported along marking media path 121.

As marking media path 121 enters marking engine 130, the sheets being transported enter a sheet diverter 131. Sheet diverter 131 separates the consumable package from the sheets of ordinary marking media. The sheet diverter 131 may operate under the control of the processor, that sends a signal to sheet diverter 131 whenever a consumable package has entered sheet diverter 131. Alternatively, the sheet diverter 131 may detect the presence of consumable package by detecting distinguishing mark on consumable package.

Consumable packages are transported along a consumable package path 132 to consumable replenisher 140, whereas the sheets of ordinary marking media are transported along a marking media path 133 to the marking device 135. Marking device 135 forms the image on the marking media according to data received by the self-replenishing image forming apparatus 100.

Although not shown for clarity, marking device 135 may include additional components, such as a charging station which charges a photoconductive surface, an exposing substation in which the photoconductive surface is selectively discharged in areas corresponding to the data to form a latent image of the data, a developing substation in which the latent image is developed by applying toner to the marking media surface, an intermediate image transfer mechanism, and a fixing station which thermally fixes the toner onto the marking media. In this case, the consumable may be the toner which is applied to the marking media at the developing substation. Alternatively, the marking device 135 may be an ink jet printer, which applies ink from an ink reservoir to the surface of the marking media, according to the data to be imaged. In another case the consumable may be an electronically active material such as an organic semiconductor, or insulator or conductor, used to procduce electronic components and circuits in an image-wise manner. In general any consumable for image-wise deposition on a sheet fed marking media can be resupplied in a similar manner. In any case, the consumable may be ink. In either case, the finished documents are output to the document output 160.

For the sake of clarity, the marking device 135 is depicted as only having a single replenisher 140, as may be the case for a black-and-white or single color copier or printer. In the case of a color copier, three or more sets of charging, exposing and developing substations may be present, and each set may have the appropriate consumable replenisher 140. Similarly, for the case of a color printer, three or more sets of marking devices 135 may be present. The processor would provide a signal to activate the proper replenisher 140 for the color of consumable being transported in the consumable package.

As mentioned above, the consumable packages are transported by the consumable package path 132 to the consumable replenisher 140. The first station of consumable replenisher 140 is the consumable unpackager 142. The consumable unpackager 142 may be a roller that peels or delaminates plastic packaging material from consumable package, to expose bare consumable. Alternatively, the consumable unpackager 142 may be a device which dissolves, melts, sublimates, evaporates, decomposes, or otherwise frees the consumable from the packaging material.

The bare consumable is then transported to the consumable transformer 144. Consumable transformer 144 transforms the state of the consumable from one which can be transported by the marking media path, to one that can be stored in the consumable reservoir 146. Consumable transformer 144 may be, for example, a heater which melts bare consumable, which then flows into consumable reservoir 146. Consumable reservoir 146 may be a vessel which stores the consumable for use by marking device 135. A support roller 148 may be provided to support any waste material, such as a plastic backing of the consumable package, to be ejected into the waste output 150. The waste output 150 may be emptied periodically by maintenance personnel, without interrupting the operation of self-replenishing image forming apparatus 100, and the packaging material may be returned to the consumable packager 108 for reuse.

As an alternative to a heater, consumable transformer 144 may be a solvent reservoir, which dissolves the consumable from a supporting matrix. The consumable may then precipitate from the solvent in the consumable reservoir 146. The consumable transformer 144 may also be an evaporator, or a sublimator, each of which transforms the consumable into a form which may be stored in the consumable reservoir 146.

Using the self-replenishing image forming apparatus 100, the color outputof the marking engine 130 may be changed without opening the self-replenishing image forming apparatus 100. To accomplish a color change, a processor may direct the consumable packager 108 to prepare consumable packages containing the desired color or color adjunct of consumable material, in this case, the desired color of ink. Consumable package is then transported to the appropriate consumable replenisher 140, as described above, in which the appropriate consumable reservoir 146 is replenished with consumable material of the desired color. Accordingly, the color change for marking engine 130 may be accomplished completely under computer control, with no human intervention required. Replenisher could have optional waste outlet to purge previous consumable material.

FIG. 5 shows an exemplary system for a self-replenishing image forming apparatus 1000. Self-replenishing image forming apparatus 1000 may include a processor 1100, a memory 1200, a consumable packager 1300, a data input/output interface 1400, a paper feed 1500, a sheet diverter 1600, a marking device 1700, and a consumable replenisher 1800. The aforementioned components 1100–1800 may be coupled on a bus 1900, or may be integrated into an application-specific integrated circuit (ASIC), for example. Units 1300–1800 may be implemented as software stored in memory 1200 and executing on processor 1100, or may be implemented as hardware circuits, for example, in an application-specific integrated circuit (ASIC). Any hardware or software implementation which performs the function of units 1300–1800 may be used.

Data to be printed on the marking media is received through input/output interface 1400 and stored in memory 1200. The data is then transferred to the marking device 1700. The desired color for the image may be input along with the image data by the input/output interface 1400. After a certain amount of color consumable has been used from the replenisher processor 1100 sends a command to consumable packager 1300 to prepare a consumable package of the appropriate color and insert the consumable package into the marking media path. Alternatively, the processor may receive an indication from a sensor in the consumable reservoir of marking device 1700 that the reservoir of consumable is running low. In response, the processor may command consumable packager 1300 to prepare a consumable package of the appropriate color and insert the package into the marking media path.

Upon confirmation from consumable packager 1300 that the consumable package has been prepared and inserted into the marking media path, processor 1100 may inform sheet diverter 1600 of when to expect the consumable package. At the time indicated by processor 1100, sheet diverter 1600 may divert the consumable package onto the consumable package path to the consumable replenisher 1800. Consumable replenisher 1800 then activates the consumable unpackager and consumable transformer to deposit the consumable material in the consumable reservoir. The sheet diverter then resumes directing the regular sheets of marking media to the marking device 1700.

Alternatively, sheet diverter 1600 may contain a sensor which detects the presence of the package distinguishing mark. The sheet diverter then diverts the consumable package onto the consumable package path, if the sensor detects the presence of the appropriate package distinguishing mark. If there is more than one possible destination for the consumable package, the mark or marks may encode the destination also. The marks may be, for example, printed on the sheet in the consumable packager 1300.

FIG. 6 shows an exemplary method of operating a self-replenishing image forming apparatus. The process starts in step S100, and continues to step S110, where a consumable package is prepared. In step S120, the consumable package is fed into the marking media path. In step S130, the consumable package is diverted from the marking media path. In step S140, the consumable package is unwrapped, or delaminated. In step S150, the consumable supply is replenished by depositing the consumable from the consumable package into the consumable reservoir. In step S160, the consumable packaging is discarded. The process ends in step S170.

The process shown in FIG. 6 is exemplary only, and it should be understood that various changes may be made to the process. For example, a consumable may be used without a package, if the consumable itself has a form which is flexible and durable enough to be transported through the marking media path without protective packaging. In this situation, step S140 may be omitted from the process. Similarly, step S150 may additionally include the operations of transforming the form of the consumable into a form which can be stored in the consumable reservoir and used by the self-replenishing image forming apparatus.

While various details have been described in conjunction with the exemplary implementations outlined above, various alternatives, modifications, variations, improvements, and/or substantial equivalents, whether known or that are or may be presently unforeseen, may become apparent upon reviewing the foregoing disclosure. For example, numerous alternative packaging schemes and transforming schemes can be envisioned. Accordingly, the exemplary details set forth above are intended to be illustrative, not limiting.

What is claimed is:

1. A non-marking media consumable material for use in a self-replenishing image forming apparatus, comprising:

a packaging that contains a consumable material for marking a marking media that is used in an image forming apparatus, the packaging being formed so as to be transported with the consumable material by a marking media transport mechanism of the self-replenishing image forming apparatus.

2. The material of claim 1, wherein the packaging further comprises a distinguishing mark, which distinguishes non-paper consumable material from the marking media, the distinguishing mark enabling the marking media transport mechanism to separate the packaging from the marking media when the packaging and the marking media are transported on a same path in the marking media transport mechanism.

3. The material of claim 1, wherein the packaging is removable from the consumable material by at least one of melting, evaporating, dissolving, sublimating, pneumatic extraction, squegeeing, and delaminating.

4. The material of claim 1, wherein the consumable material comprises a liquid, and the packaging completely encloses the consumable material.

5. The material of claim 1, wherein the packaging is less than about $1/16^{th}$ inch thick along portions that contact the marking media transport mechanism.

6. The material of claim 1, wherein the consumable material is at least one of toner and ink.

7. A self-replenishing system for an image forming apparatus, comprising:

a sheet diverter that separates packages of consumable material from sheets of marking media; and at least one of a consumable transformer that transforms the consumable material from a form transportable in the packages to a form storable in a consumable reservoir, and a consumable packager which packages the consumable material in a form transportable by a marking media transport mechanism of the self-replenishing image forming apparatus.

8. The system of claim 7, further comprising:

a consumable unpackager, which separates the consumable material from a packaging material.

9. A method of replenishing a consumable reservoir in an image forming apparatus, comprising:

diverting a consumable package from a marking media path of the image forming apparatus;

delivering a consumable material from the consumable package to a consumable reservoir.

10. The method of claim 9, further comprising:

unpackaging the consumable material from the consumable package.

11. The method of claim 9, further comprising:

transforming the consumable material prior to delivery of the consumable material to the consumable reservoir.

12. The method of claim 10, wherein unpackaging the consumable material further comprises at least one of melting, dissolving, sublimating, delaminating, decomposing and evaporating a packaging material from the consumable material.

13. The method of claim 11, wherein transforming the consumable material comprises at least one of melting, evaporating, sublimating, chemically reacting, and dissolving the consumable material.

14. The method for replenishing a consumable reservoir of claim 9, wherein the consumable material comprises at least one of toner and ink.

15. The method of claim 10, further comprising:

packaging the consumable material in a flexible packaging material to form the consumable package; and inserting the consumable package into a stream of marking media traveling in the image forming apparatus.

16. The method of claim 15, wherein the packaging further comprises:

sealing the packaging material around an edge of the consumable package.

17. The method of claim 15, further comprising:

reusing the consumable package as flexible packaging material.

18. The method of claim 15, wherein packaging the consumable material further comprises:

at least one of laminating a solid consumable material to the packaging material, adhering a solid consumable material to the packaging material, and filling a fill region in the consumable package with a liquid consumable material.

19. The method of claim 9, further comprising:

detecting a distinguishing mark on the consumable package.

* * * * *